US005532712A

United States Patent [19]

Tsuda et al.

[11] Patent Number: 5,532,712

[45] Date of Patent: Jul. 2, 1996

[54] DRIVE CIRCUIT FOR USE WITH TRANSMISSIVE SCATTERED LIQUID CRYSTAL DISPLAY DEVICE

[75] Inventors: Yukihiro Tsuda; Akira Mori, both of Hiratsuka, Japan

[73] Assignee: Kabushiki Kaisha Komatsu Seisakusho, Tokyo, Japan

[21] Appl. No.: 290,600

[22] Filed: Aug. 15, 1994

Related U.S. Application Data

[62] Division of Ser. No. 47,654, Apr. 13, 1993, abandoned.

[51] Int. Cl.[6] ..... G09G 3/36

[52] U.S. Cl. ..... 345/87; 345/100; 345/204

[58] Field of Search ..... 345/87, 88, 94–100, 345/76, 68, 204, 205; 348/790, 791, 792

[56] References Cited

U.S. PATENT DOCUMENTS

| | | | |
|---|---|---|---|
| 4,775,860 | 10/1988 | Delgrange et al. | 345/68 |
| 4,825,203 | 4/1989 | Takeda et al. | 345/100 |
| 4,866,349 | 9/1989 | Weber et al. | 345/68 |
| 4,917,468 | 4/1990 | Matsuhashi et al. | 345/87 |
| 5,040,874 | 8/1991 | Fukuda | 345/87 |
| 5,041,822 | 8/1991 | Hayashi | 345/87 |
| 5,070,255 | 12/1991 | Shin | 345/87 |
| 5,091,722 | 2/1992 | Kitajima et al. | 348/792 |
| 5,120,991 | 6/1992 | Takahashi | 345/204 |
| 5,194,853 | 3/1993 | Asada | 345/100 |
| 5,251,051 | 10/1993 | Fujiyoshi et al. | 348/792 |
| 5,253,093 | 10/1993 | Takeda et al. | 345/87 |
| 5,315,315 | 5/1994 | Nakamura | 345/76 |

FOREIGN PATENT DOCUMENTS

| | | |
|---|---|---|
| 1-134497 | 5/1989 | Japan . |
| 4-325284 | 11/1992 | Japan . |
| 5-42379 | 2/1993 | Japan . |

OTHER PUBLICATIONS

"Data Book 1988–1989, Supertex", Supertex, Inc., California, pp. 11–129 through 11–133.

"Cross–Modulation and Disuniformity Reduction in the Addressing of Passive Matrix Displays":, Maltese, Fourth Display Research Conference (Sep. 18–20, 1984), Paris.

*Primary Examiner*—Richard Hjerpe
*Assistant Examiner*—M. Fatahiyar
*Attorney, Agent, or Firm*—Richards, Medlock & Andrews

[57] ABSTRACT

A drive circuit, for use with a transmissive scattered liquid crystal display device, prevents a residual image caused by a high speed display switching, while having a reduced size and fewer parts, thereby improving reliability. The drive circuit comprises a shift register (3*a*), a first gate for functioning as an AND circuit (2*a*), a second gate for functioning as an exclusive OR circuit (2*b*), and a switching device (7) with a higher withstand voltage than a logic signal. These constructional elements are formed within an IC. A logic signal for driving the liquid crystal display device is input to the second gate (2*b*). The output of the buffer (8) is connected to a totem pole drive circuit (10) for driving a common electrode (C) with a high voltage (HV) which is synchronized with the logic signal.

7 Claims, 11 Drawing Sheets

DRIVE CIRCUIT FOR USE WITH TRANSMISSIVE SCATTERED LIQUID CRYSTAL DISPLAY DEVICE

RELATED APPLICATION

This is a division of application Ser. No. 08/047,654 filed in Apr. 13, 1993, now abandoned.

FIELD OF THE INVENTION

The present invention relates to a modification of a drive circuit for use with a transmissive scattered liquid crystal display device.

BACKGROUND OF THE INVENTION

Since a transmissive scattered liquid crystal (also termed a polymer scattered liquid crystal) does not include a deflection plate, the transmittance thereof is high when it displays data. Thus, the transmissive scattered liquid crystal is very suitable for an application which requires a high transmittance. However, when a DC voltage is applied to a transmissive scattered liquid crystal, an electrolysis takes place, thereby reducing the life of the liquid crystal. Therefore, when the liquid crystal is driven, an AC voltage should be applied.

Known drive methods for transmissive scattered liquid crystal display devices include a static drive method and a multiplex drive method. In the static drive method, one end of an electrode of each pixel is connected to one common line so as to switch the other end thereof. In the multiplex drive method, which uses two or more common electrodes, each common electrode is selected and driven on a time division basis. FIG. 1 shows a conceptional schematic diagram of the static drive method. FIG. 2 shows a conceptional schematic diagram of the multiplex drive method.

FIG. 3 shows a circuit diagram of the static drive method for one pixel 1 of a liquid crystal display device. FIG. 4 shows a drive waveform diagram for the circuit of FIG. 3. An exclusive OR gate 2 is used as the drive circuit for the pixel 1 of the liquid crystal display device. When a square shaped AC voltage $V_c$ is applied to one electrode C of the pixel 1 of the liquid crystal display device and to one input of the exclusive OR gate 2 while an ON portion of the ON/OFF signal $V_{sig}$ is being applied to another input of the exclusive OR gate 2, an inverted voltage $V_8$, wherein the plus and minus of the square shaped voltage $V_c$ is inverted by the exclusive OR gate 2, is applied to the other electrode S. Thus, a liquid crystal applying voltage ($V_c$–$V_s$) is applied between the electrodes C and S of the pixel 1, and thereby data appears on the pixel. In contrast, when the ON/OFF signal $V_{sig}$ is turned off, the voltage applied to the pixel 1 of the liquid crystal display device becomes zero, and thereby the data on pixel 1 disappears. While a single common electrode can be connected to each pixel, this circuit configuration requires a number of exclusive OR gates 2 corresponding to the number of pixels in order to be able to apply a control signal to each pixel of the liquid crystal display device.

Although the multiplex drive method requires a plurality of common electrodes, it can drive the liquid crystal display device with a lesser number of data electrodes (i.e., number of all pixels/number of common electrodes) than that of the static drive method. Thus, the multiplex drive method is suitable for driving a liquid crystal display device with a large area and a large number of pixels. However, when the liquid crystal display device is driven in the multiplex drive method, an AC voltage should be applied as in the static drive method in order to avoid reducing the life of the liquid crystal display device. Thus, the plus and minus of a drive voltage for the liquid crystal according to the multiplex drive method should be changed as shown in FIG. 5.

FIG. 6 shows a method for applying voltages to pixels of a liquid crystal with first and second common electrodes $C_1$ and $C_2$ and first, second, and third data electrodes $D_1$, $D_2$, and $D_3$. FIG. 7 shows waveforms of voltages applied to these pixels. In FIG. 6, pixels $G_1$, $G_2$, and $G_4$ denoted by solid black dots are non-display or unlit pixels, whereas pixels $G_3$, $G_5$, and $G_6$ denoted by white dots are display or lit pixels.

The drive voltages of the transmissive scattered liquid crystal display devices according to the static drive method and the multiplex drive method are high. For example, these liquid crystal display devices normally require a drive voltage as high as 40 V as effective values. Thus, the drive voltage according to the static drive method is higher than the withstand voltage of a dedicated integrated circuit (IC) which performs a static drive. Therefore, discrete devices such as power transistors and Triac devices have been used to provide a number of drive circuits corresponding to the number of pixels. For example, when a liquid crystal display panel of 24 dots by 24 dots is driven according to the static drive method, 576 drive circuits should be formed in order to separately drive the 576 pixels.

On the other hand, a drive voltage of around 40 V is required for operations according to the multiplex drive method. This drive voltage is higher than the withstand voltage of a dedicated IC which drives a conventional TN (Twisted Nematic) type liquid crystal display device according to the multiplex drive method. Thus, as in the static drive method, a number of circuits corresponding to the number of pixels have been formed with discrete devices such as power transistors and Triac devices. For example, to drive a liquid crystal display panel having 72 dots by 36 dots according to the multiplex drive method by using two common electrodes, 1296 drive circuits corresponding to 2592 pixels (because 72×36/2=1296) should be formed.

In both the static drive method and the multiplex drive method, a large number of parts are required when the drive circuits are formed of discrete devices. Accordingly, the following problems result:

A very large space is required.

The reliability of the drive circuits is degraded. In particular, power devices adversely affect the drive circuits.

When a defect occurs, troubleshooting and/or maintenance takes a long time.

If the drive circuits were to be formed as part of an IC, the number of parts could be remarkably reduced. However, since the drive voltage of the transmissive scattered liquid crystal display device is high, it cannot be driven by a dedicated IC.

Japanese Published Unexamined Patent Application (A) 4-325284 and Japanese Published Unexamined Patent Application (A) 5-42379, assigned to the assignee of the present application, disclose a technique for using a transmissive scattered liquid crystal display device as a mask of a laser marker. In addition, the inventors of the present invention are developing a technique for driving such a liquid crystal according to the multiplex drive method.

Before data is written on a liquid crystal display device, the liquid crystal display device should be satisfactorily discharged. Otherwise, residual portions of a previously produced image may remain on the display, thus degrading the marking quality. Therefore, in developing a technique for driving a liquid crystal display device according to the multiplex drive method, countermeasures for preventing a residual image should be taken.

An example of such a residual image protection technique is disclosed in Japanese Published Unexamined Patent Application (A) 1-134497. According to this technique, when an image on the liquid crystal display device is to be changed, a voltage in a non-display level is applied to an electrode of each pixel just before a voltage supply route to both electrodes of each pixel is shut off.

In recent years, the need for high speed printing with a laser marker has become strong. The inventors of the present invention applied the technique disclosed in Japanese Published Unexamined Patent Application (A) 1-134497 to the laser marker that they are developing. As an experimental result, when the printing speed was low, an effect was confirmed. However, when the printing was performed at a high speed, a residual image remained. Thus, the marking quality was degraded.

SUMMARY OF THE INVENTION

A first object of the present invention is to provide a drive circuit, for use with a transmissive scattered liquid crystal display device according to the static drive method or the multiplex drive method, which can be formed as part of an IC so as to decrease the number of constructional parts thereof, to remarkably reduce the size thereof, to remarkably improve the reliability of the drive circuits, and to reduce maintenance time required by the occurrence of a defect.

A second object of the present invention is to provide a drive circuit, for use with a transmissive scattered liquid crystal display device, which allows an image to be quickly changed without the occurrence of a residual image.

To accomplish the first object, the inventors of the present invention considered forming both a static drive circuit and a multiplex drive circuit for use with a transmissive scattered liquid crystal display device by using ICs which were developed for other than transmissive scattered liquid crystal display devices. In other words, to accomplish the drive circuit, the IC should contain a logic device which functions as an exclusive OR circuit so that, with a logic signal applied to the logic device, the plus and minus of a square shaped voltage applied to the liquid crystal display device should be changed. In addition, the display state and non-display state should be changed. Moreover, the withstand voltage of the output of the IC should be at least as high as 80 V. For the static drive circuit, the exclusive OR device should be preceded by a logic device which functions as an AND circuit so as to easily perform blanking control of the liquid crystal display device (in the blanking state, control signals are reset and incremented while no image appears).

One available IC which has such an function is an IC which was designed to symmetrically drive an electroluminescence (hereinafter referred to as EL) display device. According to the symmetrical drive method, when an high voltage output is turned on, the corresponding pixel does not always light. Instead, when the high voltage output is turned off, the pixel may light. To control this operation, a logic device which functions as an exclusive OR circuit is contained in the drive IC for the EL display device.

In addition, since the drive voltage of the EL display device is normally as high as 80 to 90 V, the output withstand voltage of the IC can satisfactorily drive a transmissive scattered liquid crystal display device. Moreover, since this IC was designed for driving an EL display device, it contains a logic device which can function as an AND circuit for performing the blanking control. Thus, this EL drive IC is suitable for use as the drive circuit for a liquid crystal display device according to the static drive method.

However, since control logic signals used for driving the EL display device largely differ from those for driving the static drive circuit and the multiplex drive circuit for a liquid crystal display device, such control logic signals should be newly created.

Therefore, in one aspect the present invention is a drive circuit for use with a transmissive scattered liquid crystal display device having a plurality of pixels, the drive circuit comprising: a shift register; a plurality of first gates, each first gate functioning as an AND circuit; a plurality of second gates, each second gate functioning as an exclusive OR circuit; and a plurality of switching devices, each switching device having a withstand voltage which is higher than any logic signal applied thereto; wherein the shift register, the plurality of first gates, the plurality of second gates, and the plurality of switching devices are formed as part of an IC; wherein each second gate is connected to a drive logic signal circuit for applying a drive logic signal having a frequency which is the same as that at which the liquid crystal display device is driven; wherein each first gate is connected to a blanking logic signal circuit for applying a blanking designation logic signal; wherein the shift register is connected to a display signal circuit for serially sending a display signal with a logic signal level to the shift register; wherein a data output of each switching device is connected to a respective pixel of the transmissive scattered liquid crystal display device; and wherein a common electrode of the transmissive scattered liquid crystal display device is connected to a voltage applying circuit, the voltage applying circuit being adapted to synchronize with the drive logic signal, thereby static-driving the transmissive scattered liquid crystal display device.

In another aspect, the present invention is a drive circuit for use with a transmissive scattered liquid crystal display device having a plurality of pixels, the drive circuit comprising: a shift register; a plurality of gates for functioning as an exclusive OR circuit; and a plurality of switching devices, each switching device having a withstand voltage which is higher than any logic signal applied thereto; wherein the shift register, the plurality of gates, and the plurality of switching devices are formed as part of an IC; wherein each gate is connected to a logic signal circuit for applying a logic signal for designating the plus and minus of a voltage applied to the liquid crystal display device; wherein the shift register is connected to a display signal circuit for serially sending a display signal with a logic signal level to the shift register; wherein a data output of each switching device in a first group of switching devices is connected to a respective one of a first group of the plurality of pixels of the transmissive scattered liquid crystal display device; wherein a data output of each switching device in a second group of switching devices is connected to a respective one of a second group of the plurality of pixels of the transmissive scattered liquid crystal display device; and wherein a first common electrode of the transmissive scattered liquid crystal display device is connected to each switching circuit of the first group of switching circuits, wherein a second common electrode of the transmissive scattered liquid crystal display device is connected to each switching circuit of the second group of switching circuits, thereby multiplex-driving the transmissive scattered liquid crystal display device.

In the case of the drive circuit according to the static drive method, the drive logic signal with the frequency at which the liquid crystal display device is driven according to the static drive method is applied to each of the exclusive OR gates. The blanking logic signal is sent to each of the gates which function as the AND circuits. The display signal with a logic signal level is serially sent to the shift register. It is not necessary to cause the drive logic signal applied to the gate which functions as the exclusive OR circuit to synchronize with other logic signals.

In the case of the drive circuit according to the multiplex drive method, the logic signals which designate the plus and minus of the applied voltage and the display state and non-display state are applied to each of the gates which function as exclusive OR circuits. The display signal with a logic signal level is serially sent to the shift register.

For both drive methods, since the drive circuits are formed as part of an IC, the number of constructional parts can be remarkably reduced. Thus, the apparatus of the final product can be compactly formed.

To accomplish the second object, the present invention is a drive circuit for use with a transmissive scattered liquid crystal display device having a plurality of pixels, each of which is connected to a common electrode and a data electrode, the drive circuit being adapted to apply voltages corresponding to a drive command to the common electrode and the data electrode of selected pixels so as to cause each selected pixel to light, the drive circuit being adapted to turn off the drive command in a predetermined display switching time so as to switch the display of each pixel, wherein each of the common electrodes and each of the data electrodes has a switch with a small on-resistance, each switch being adapted to discharge electric charges applied on the respective one of the common electrodes and the data electrodes in a predetermined time, each switch being adapted to be turned on when the drive command is turned off so that the voltages of the common electrodes and the data electrodes become identical, thereby preventing a residual image of the liquid crystal display device from taking place.

In other words, the number of switches provided corresponds to the total of the number of common electrodes plus the number of data electrodes, the switches being adapted to discharge electric charges applied to both electrodes of each pixel. Whenever an image on the liquid crystal display device is changed, the switches are operated and thereby electric charges of both electrodes of each pixel are discharged so that the voltage of one electrode becomes the same as that of the other electrode. In addition, the on-resistance of the switches is so low as to satisfactorily discharge electric charges in a short display switching time. Thus, while electric charges are discharged, the time constant becomes low. Even if an image is changed at high speed, no residual image takes place, since electric charges are quickly discharged.

DETAILED DESCRIPTION

Figure 1:
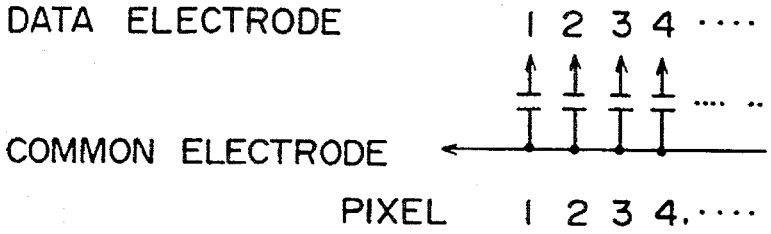
FIG. 1 is a conceptual schematic diagram showing a static drive method.
Figure 2:
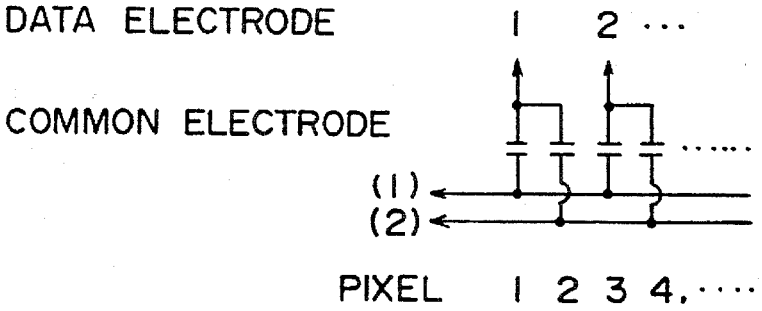
FIG. 2 is a conceptual schematic diagram showing a multiplex drive method.
Figure 3:
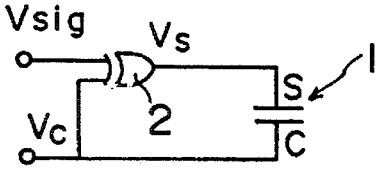
FIG. 3 is a schematic diagram showing a drive circuit according to the static drive method.
Figure 4:
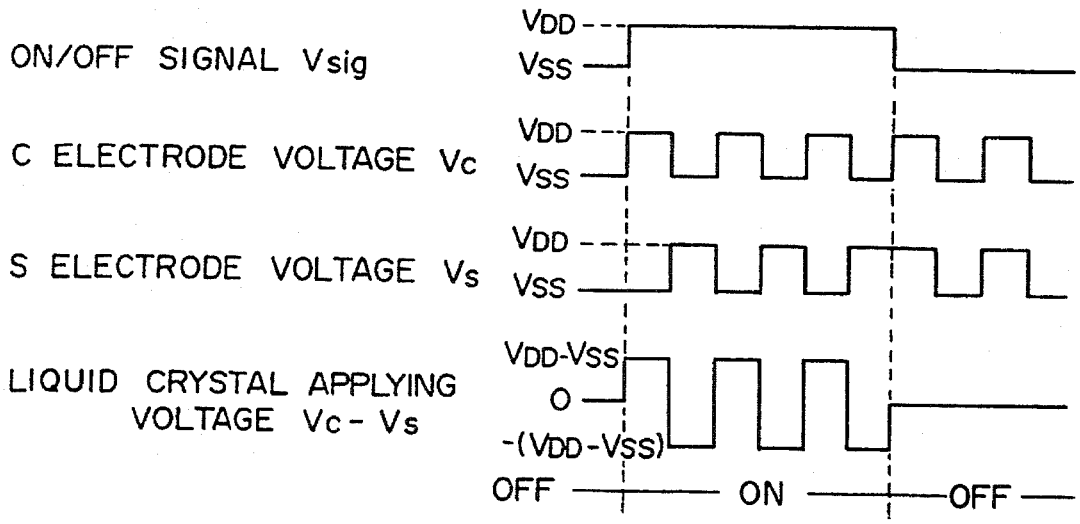
FIG. 4 is a timing chart of a liquid crystal display device pixel having the drive circuit of FIG. 3.
Figure 5:
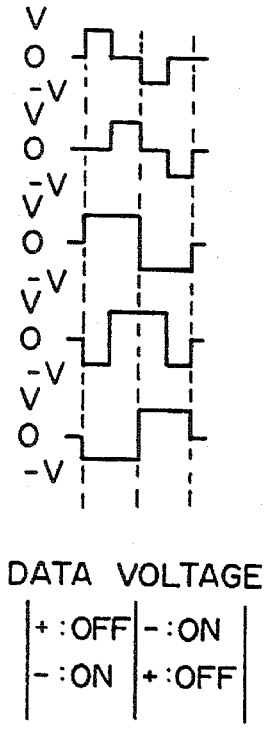
FIG. 5 is a timing chart of a liquid crystal display device according to the multiplex drive method.
Figure 6:
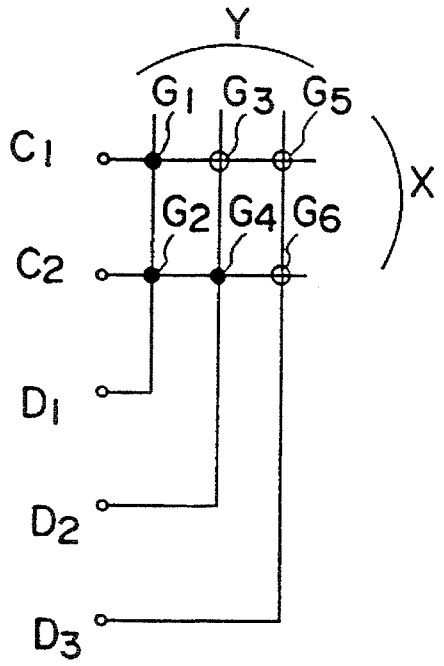
FIG. 6 is a conceptual schematic diagram showing the construction of a liquid crystal display device according to the multiplex drive method.
Figure 7:
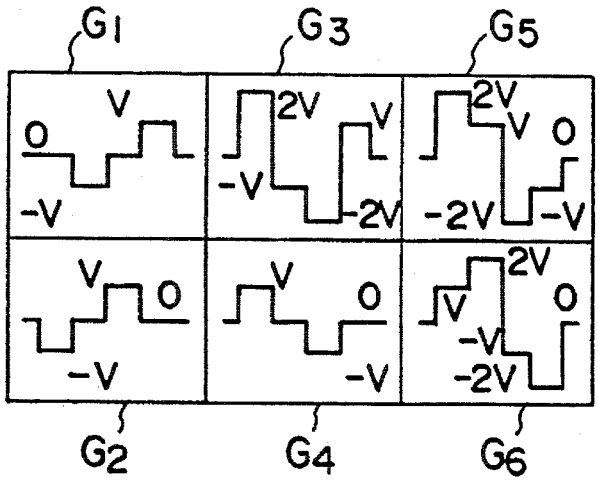
FIG. 7 is a schematic diagram showing the waveforms of voltages applied to the pixels of FIG. 6.
Figure 8:
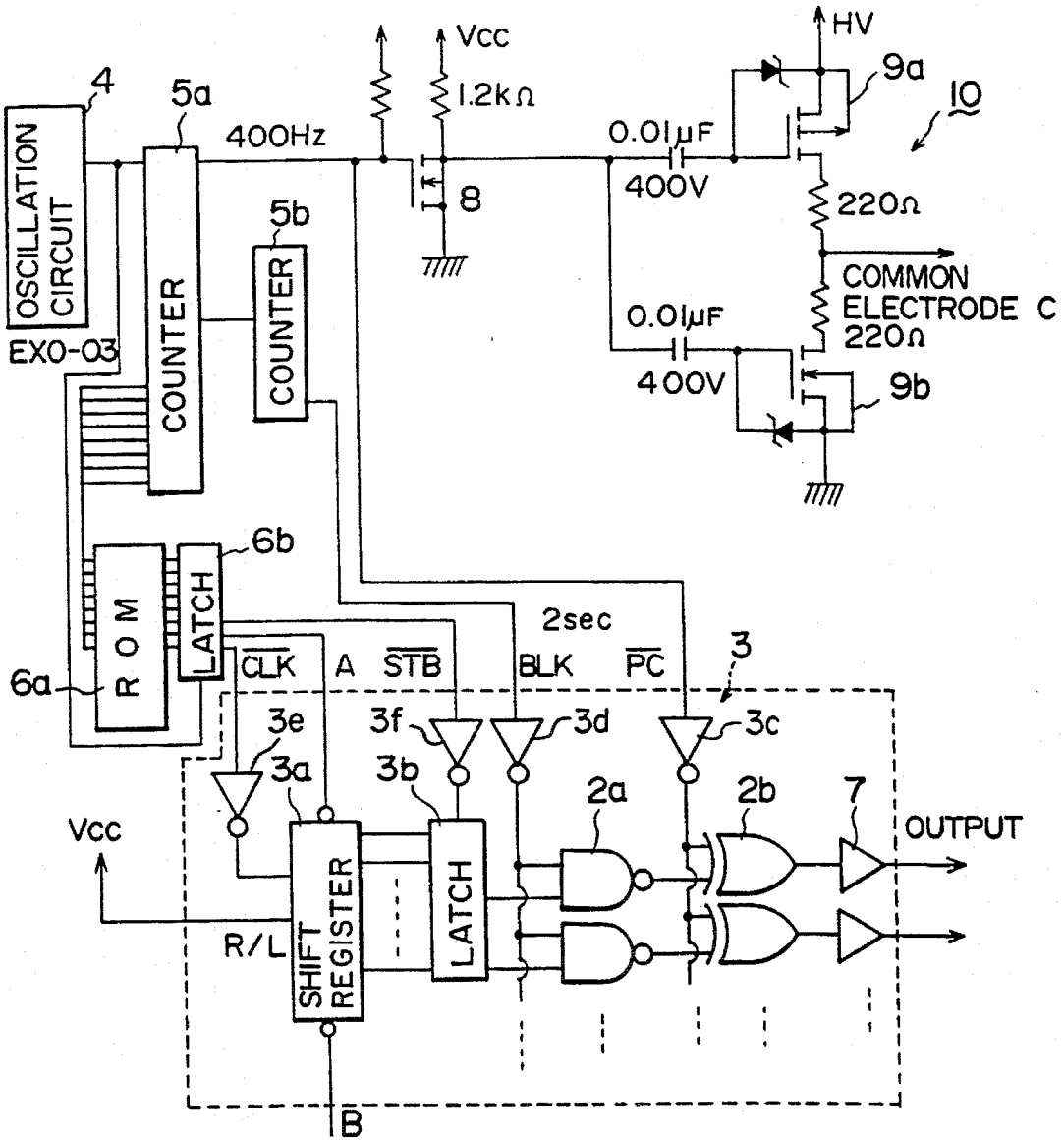
FIG. 8 is a schematic diagram showing a first embodiment of the present invention as a drive circuit for the static drive method.

With reference to FIG. 8, a first embodiment of the present invention will be described in terms of the basic construction of a drive circuit for the static drive method.

In FIG. 8, device 3 is a drive IC which is manufactured by NEC Corp. with the designation μPD16306. It should be noted that the drive IC 3 is not limited to such a device. For example, by considering the logic inversion of control signals, an IC designed to symmetrically drive an EL display device can be used. An example of this latter type of IC is manufactured by Supertechs Corp. with the designation HVO3. The drive IC 3 comprises a shift register 3*a*, a latch 3*b*, a plurality of first gate circuits 2*a*, a plurality of second gate circuits 2*b*, and a plurality of switching devices 7. A first gate circuit 2*a*, a second gate circuit 2*b* and a switching device 7 provide a drive path for a respective data electrode. Where the desired number of data electrodes exceeds the number of drive paths available on the drive IC 3, one or more additional drive ICs can be provided, with the B terminal of one drive IC being connected to the A terminal of a subsequent drive IC so that the drive ICs function together as a unified IC having the desired number of drive paths.

In FIG. 8, the $\overline{PC}$ terminal is connected through an inverter 3*c* to a first input of each of the plurality of gate circuits 2*b*, with each gate circuit 2*b* functioning as an exclusive OR circuit. This $\overline{PC}$ terminal is also connected to a drive logic signal circuit which applies a drive logic signal for driving a liquid crystal display device according to the static drive method. In the first embodiment, with a drive logic signal circuit composed of an oscillation circuit 4 and a counter 5*a*, a square shaped logic signal having a frequency of 400 Hz and a duty of 50% is applied to the $\overline{PC}$ terminal. Results of experiments conducted by the inventors show that regardless of whether or not the drive logic signal synchronizes with other logic signals, the liquid crystal display device can be driven without abnormality and difference. The output of each gate circuit 2*b* is connected to an input of a respective one of the switching devices 7. Each switching device 7 is a CMOS driver which has a high withstand voltage and is disposed as the last stage of the IC 3, with a data output of each switching device 7 being connected to a respective data electrode.

The BLK terminal is connected through an inverter 3*d* to a first input of each of the plurality of gate circuits 2*a*, each gate circuit 2*a* functioning as an AND circuit with an inverter connected to the output of the AND circuit. The output of each gate circuit 2*a* is connected to the second input of a respective one of the gate circuits 2*b*. This BLK terminal, which is used to perform a blanking control, is connected to a blanking logic signal circuit for applying a blanking designation logic signal. The blanking logic signal circuit comprises counter 5*b*, which has an input terminal connected to an output of counter 5*a*. Thus, the BLK signal is synchronized with the $\overline{PC}$ signal. In the first embodiment, the mode of the liquid crystal display device is switched between ON and OFF at intervals of around 2 seconds. These switching intervals can be easily changed.

The A terminal is a serial data input terminal, which is connected to one input of a shift register 3*a*. This A terminal is connected to a display signal circuit which serially sends a display signal in a logic signal level from a latch 6*b* to the shift register 3*a*.

The $\overline{CLK}$ terminal is a clock signal input terminal. This $\overline{CLK}$ terminal is connected to the latch 6*b* and through an inverter 3*e* to the shift register 3*a*. The clock signal synchronizes with the serial data supplied to the A terminal.

The B terminal of drive IC 3 is connected to the shift register 3*a* and to the A terminal of the next drive IC so that the shift registers act in concert. Each shift register 3*a* is provided with an R/L terminal which is used to designate the direction of input and output for the shift register 3*a*. In this construction, when the logic level of the R/L terminal becomes "H", the A terminal functions as an input terminal and the B terminal functions as a serial output terminal. In this manner, data can be serially sent to the adjacent drive IC.

An $\overline{STB}$ terminal is connected through an inverter 3*f* to the latch 3*b*. The latch 3*b* has parallel input terminals which are connected to parallel output terminals of the shift register 3*a*. The latch 3*b* also has a plurality of output terminals, with each output terminal of the latch 3*b* being connected to a second input terminal of a respective gate circuit 2*a*. The STB terminal is also connected to an output of latch 6*b*. ROM 6*a* and latch 6*b* provide a $\overline{STB}$ signal to latch 3*b* to strobe the latch 3*b* to thereby latch the outputs of the shift register 3*a* which are being supplied to the gate circuits 2*a*.

In the first embodiment, as an experimental circuit, a control signal was written to a ROM 6*a*. With a combination of the oscillation circuit 4 and the counter 5*a*, an address was accessed. Thus, another control signal was generated. The control signal was synchronized by the counter 5*b*. The resultant signal was connected to the drive IC 3. These control signals can be generated by a computer. These control signals are outputted through the switching devices 7 to the respective data electrodes.

The common electrode C is supplied with the same drive logic signal having a frequency of 400 Hz as the $\overline{PC}$ terminal. The resultant signal is sent to a buffer 8. The output signal of the buffer 8 drives totem pole connection circuits 9*a* and 9*b* so as to switch a high voltage HV. Thus, a voltage applying circuit 10 which applies the high voltage HV to the common electrode C is formed.

Next, with reference to FIGS. 9 to 11, a second embodiment of the present invention will be described as a drive circuit for the multiplex drive method. In this embodiment, two common electrodes were used for two groups of pixels on a transmissive scattered liquid crystal display device having 72 dots by 36 dots. To drive this liquid crystal display device according to the multiplex drive method, 1296 data electrodes and two common electrodes are required. Thus, each group of pixels contained 1296 pixels, with all of the pixels in the first group being connected to the first common electrode and all of the pixels in the second group being connected to the second common electrode, and with each of the 1296 data terminals being connected to a respective pixel in the first group and a respective pixel in the second group. The multiplex drive method is also referred to as ½ duty drive method.

Figure 9:
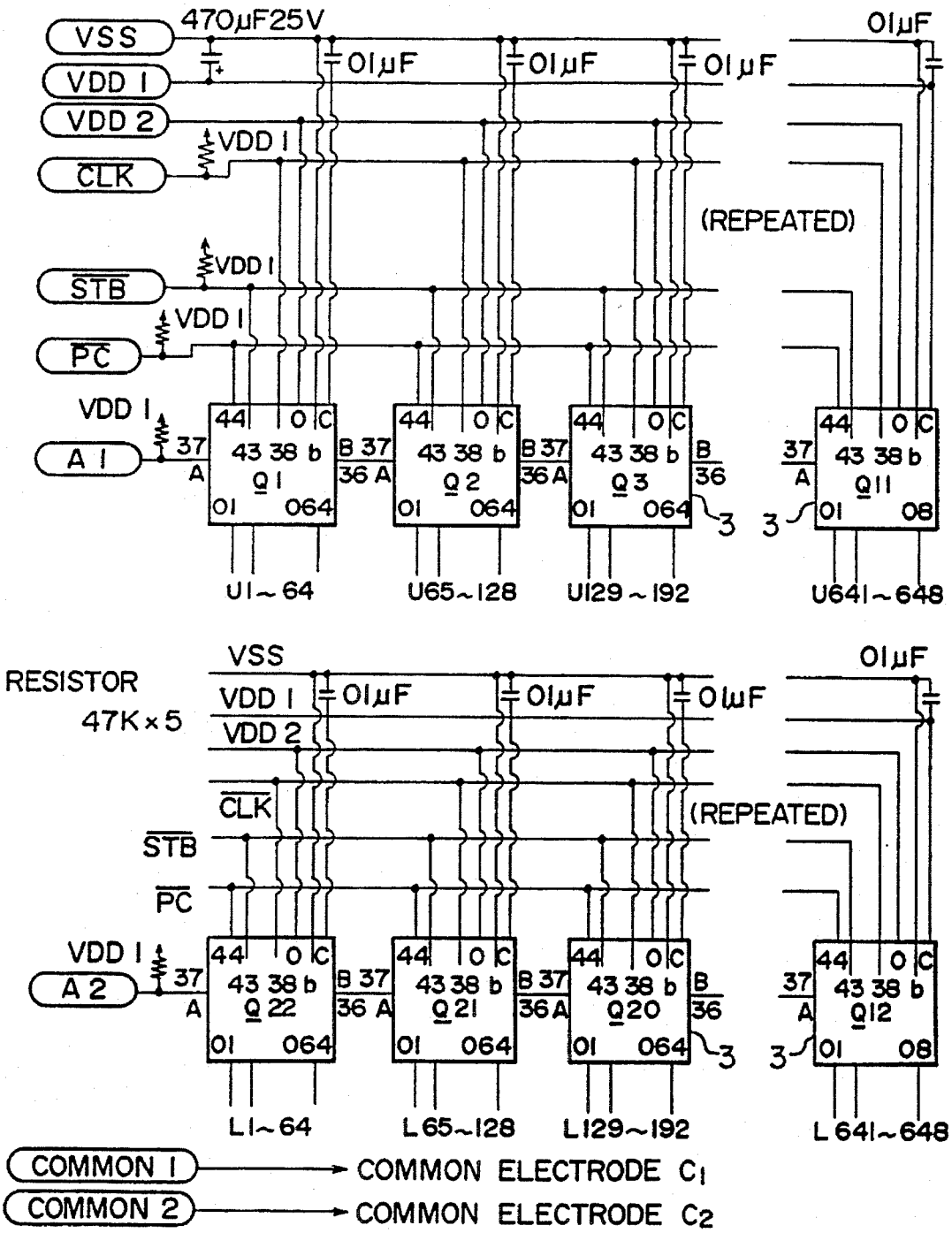
FIG. 9 is a schematic diagram showing a second embodiment of the present invention as a drive circuit on a data signal line side for the multiplex drive method.

FIG. 9 shows a circuit on the data electrode side of the drive circuit according to the second embodiment. In this embodiment, each of drive ICs Q1 to Q22 is a μPD16306 device made by NEC Corp., which is the same as the drive IC 3 of the first embodiment as illustrated in FIG. 8. In FIG. 9, a $\overline{PC}$ terminal is connected to each of the plurality of gate circuits 2*b* contained in each of drive ICs Q1 through Q22, with each gate circuit 2*b* functioning as an exclusive OR circuit for the respective drive path. This terminal is connected to a logic signal circuit which applies a drive logic signal for driving the liquid crystal display device according to the multiplex drive method.

In the second embodiment, a square shaped drive logic signal with repetitive intervals of 8.34 msec was applied. With this drive logic signal, it is determined whether a positive voltage or a negative voltage is applied when a relevant pixel lights. The blanking control is performed by switching a supply voltage, rather than by the operation of the drive ICs Q1 to Q22. Thus, the transmissive scattered liquid crystal display device can be driven with this simpler circuit construction. This point completely differs from the operation according to the drive method of the EL display panel. In the case of the EL display panel, since a very high voltage is applied, a large circuit is required if the supply voltage is switched by an external circuit. Thus, in the case of the EL display panel, the blanking control is performed by the drive ICs.

In the second embodiment of the invention, the logic level of the logic signals is fixed to "L". Terminals $A_1$ and $A_2$ are input terminals for serial data. A $\overline{CLK}$ terminal is an input terminal for a clock signal which synchronizes with the serial data. Thus, data can be sent with serial signals.

Figure 10:
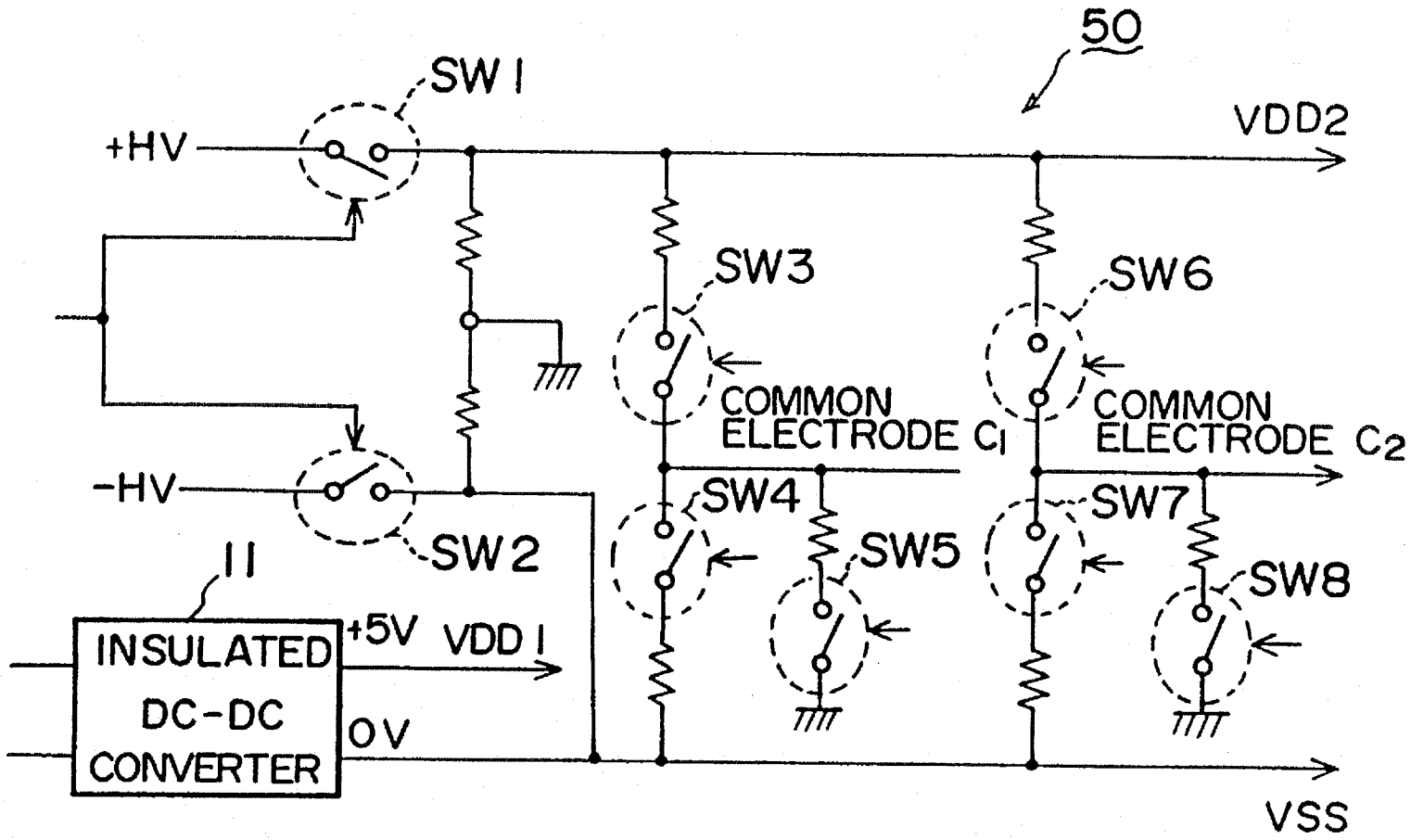
FIG. 10 is a schematic diagram showing a drive circuit on a common electrode side of FIG. 9.

The voltages of the common electrodes $C_1$ and $C_2$ are controlled by a switching circuit 50, shown in FIG. 10. The switching circuit 50 comprises analog switches SW1 to SW8 and discrete devices, depending on the characteristics and drive method of the transmissive scattered liquid crystal display device. An insulated DC—DC converter 11 outputs a +5 VDC signal $V_{DD1}$ for generating a logic signal.

Figure 11:
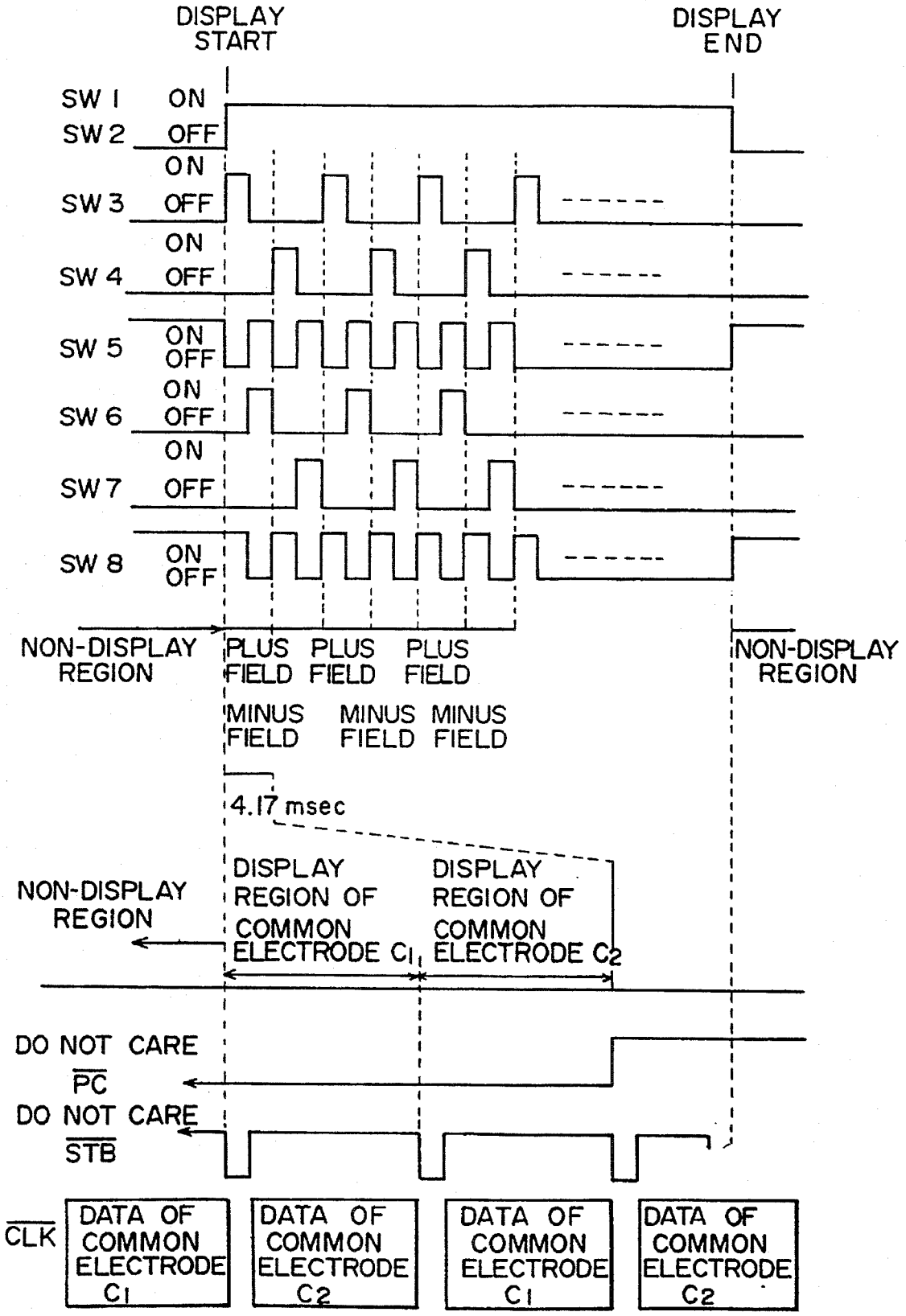
FIG. 11 is a timing chart showing the operation of the circuit of FIG. 10.

FIG. 11 is a timing chart showing operations of the switches SW1 to SW8 of the switching circuit 50 of FIG. 10, and of the drive ICs Q1 to Q22. In the second embodiment, as a control circuit, a control signal was written to a ROM 6a (see FIG. 8). With a combination of an oscillation circuit 4 and a counter 5a (as shown in FIG. 8), an address was accessed. Thus, another control signal was generated. The resultant signal was shifted to a level of $V_{ss}$–$V_{DD1}$ by a photo coupler. The resultant signal was supplied to the drive ICs Q1 to Q22 (as shown in FIG. 9). The output terminals of drive ICs Q1 to Q22 were connected to the data electrodes $D_1$, $D_2$, $D_3$, etc. of the transmissive scattered liquid crystal display device having 72 dots by 36 dots. Thus, the liquid crystal display device could be driven according to the multiplex drive method.

According to the first and second embodiments of the present invention, the space required by the drive circuit can be remarkably reduced. For example, according to a conventional static drive method, eight printed circuit boards whose space was 40×30×30 $cm^3$ were used. However, according to the present invention, only one printed circuit board whose space is 30×30×2 $cm^3$ is required.

In addition, the number of parts can be decreased. For example, according to a conventional static drive method, the number of parts of a circuit which drove a liquid crystal display device with 24 dots by 24 dots exceeded 1000. However, with a static drive circuit according to the present invention, the number of parts is 50 or less. On the other hand, according to a conventional multiplex drive method, the number of parts exceeded 2000. However, with a multiplex drive circuit according to the present invention, the number of parts is 100 or less. Thus, for both of the drive methods, the reliability of the drive circuit is remarkably improved since the number of parts can be remarkably reduced. In addition, the maintenance time need to correct a defect can be shortened.

Next, with reference to FIGS. 12 to 17, a drive circuit according to a third embodiment of the present invention will be described.

Figure 12:
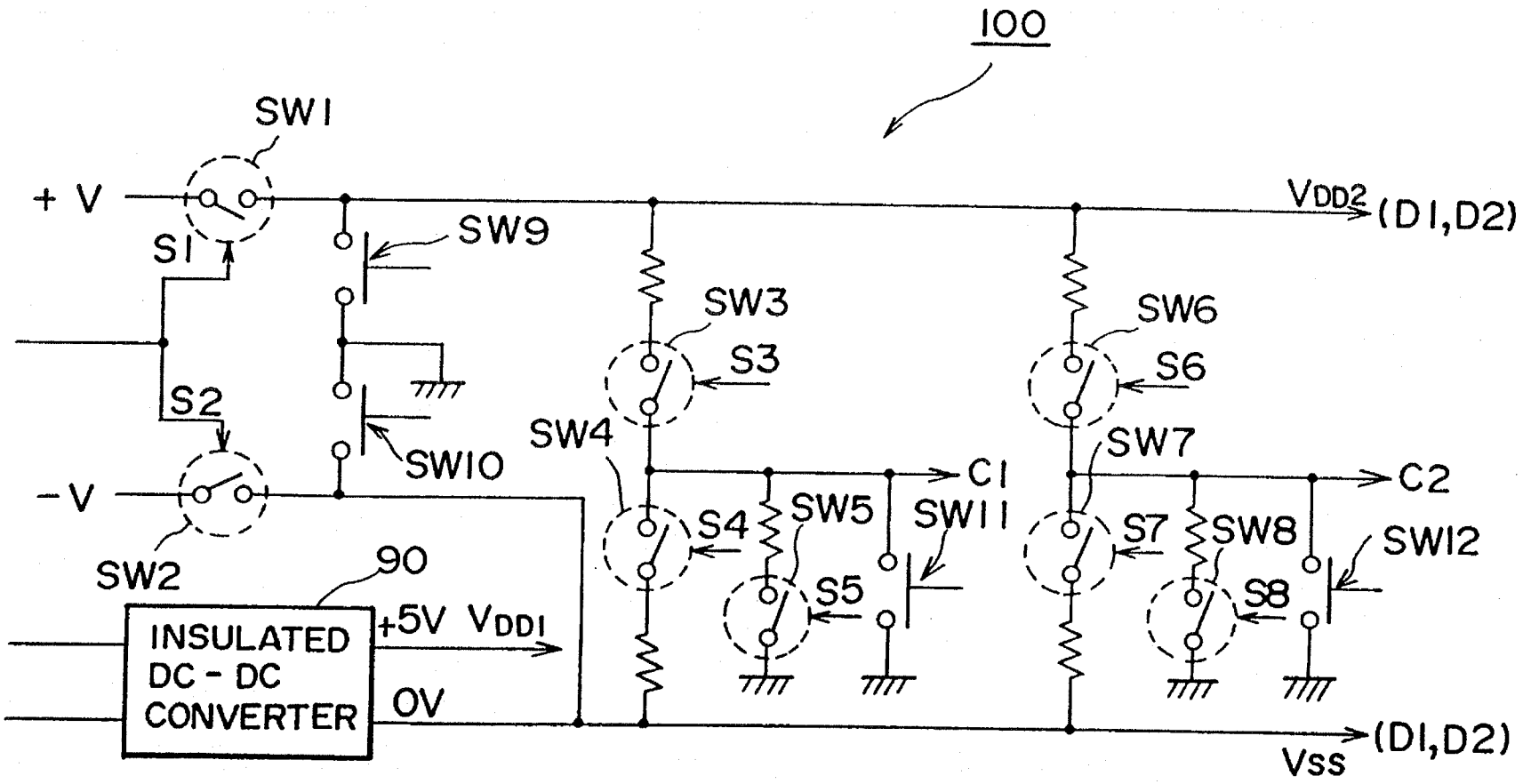
FIG. 12 is a schematic diagram showing a third embodiment of the present invention as a drive circuit for the multiplex drive method.

FIG. 12 shows a drive circuit which causes each pixel of a transmissive scattered liquid crystal display device to light. The drive circuit of the third embodiment is particularly useful where the liquid crystal display device is employed as a mask of a laser marker.

Figure 14:
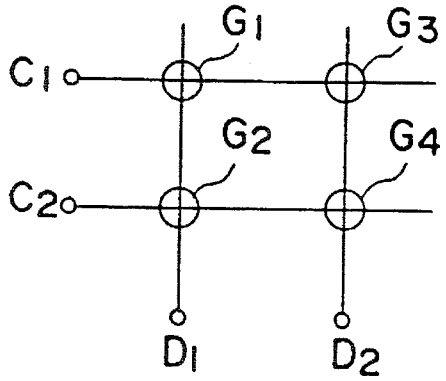
FIG. 14 is a conceptual schematic diagram showing the construction of a liquid crystal display device driven by the circuit of FIG. 12.

This drive circuit is a multiplex drive circuit comprising a first common electrode $C_1$ and a second common electrode $C_2$. As shown in FIG. 14, this drive circuit drives pixels $G_1$, $G_2$, $G_3$, and $G_4$ of the liquid crystal display device. Each pixel has a first electrode and a second electrode.. For the illustrated pixels, the first electrode is the common electrode $C_1$ or $C_2$, while the second electrode is the data electrode $D_1$ or $D_2$.

In the switching circuit 100 illustrated in FIG. 12, switches SW1 to SW8 are so-called analog switches. For example, the on-resistance $R_a$ and the operation time $t_a$ of these analog switches are 60 ohms and 300 nsec, respectively. The switches SW1 to SW8 operate corresponding to operation signals S1 to S8 received from a circuit (not shown in FIG. 12). When one of the operation signals S1 to S8 is turned on, the corresponding one of the switches SW1 to SW8 is operated to a closed position across both terminals thereof. When one of the operation signals S1 to S8 is turned off, the corresponding one of the switches SW1 to SW8 is operated to its open position.

Switches SW9 to SW12 are photo MOS switches. The on-resistance $R_p$ of these switches is 0.3 ohm, which is much smaller than those of the analog switches SW1 to SW8. The operation time $t_p$ of the switches SW9 to SW12 is 1.7 msec, which is relatively large. Switches SW9, SW10, SW11, and SW12 are disposed at the data electrode $D_1$, the data electrode $D_2$, the common electrode $C_1$, and the common electrode $C_2$, respectively. These switches are used to discharge electric charges applied on these electrodes. The switches SW9 to SW12 are operated by corresponding operation signals S9 to S12 (which are received from a circuit not shown in FIG. 12). When the operation signals S9 to S12 are turned on, the switches SW9 to SW12 are operated to their closed position across both terminals thereof. When the operation signals S9 to S12 are turned off, the switches SW9 to SW12 are operated to their open position. The circuits which output the operation signals S1 to S12 can be easily formed of flipflops or the like.

From a power supply circuit (not shown in FIG. 12), a positive voltage +V as a signal $V_{DD2}$ is supplied to a first terminal of the switch SW1. The second terminal of the switch SW1 is connected to a first one of the data electrodes $D_1$ and $D_2$. The second terminal of the switch SW1 is also connected to the common electrode $C_1$ through the switch SW3. In addition, the second terminal of the switch SW1 is connected to the common electrode $C_2$ through the switch SW6. The first one of the data electrodes $D_1$ or $D_2$is grounded through the switch SW9 when switch SW9 is in its closed position.

On the other hand, from the power supply circuit (not shown in FIG. 12), a negative voltage –V as a signal $V_{ss}$ is supplied to a first terminal of the switch SW2. The second terminal of the switch SW2 is connected to the other of the data electrodes $D_1$ and $D_2$. In addition, the second terminal of the switch SW2 is connected to the common electrode $C_1$through the switch SW4. Moreover, the second terminal of the switch SW2 is connected to the common electrode $C_2$ through the switch SW7. The other data electrode $D_1$ or $D_2$ is grounded through the switch SW10 when switch SW10 is in its closed position.

The common electrode $C_1$ is grounded through the switch SW5 when SW5 is in its closed position or through the switch SW11, which is disposed in parallel with the switch SW5, when SW11 is in its closed position. On the other hand, the common electrode $C_2$ is grounded through the switch SW8 when SW8 is in its closed position or through the switch SW12, which is disposed in parallel with the switch SW8, when switch SW12 is in its closed position.

The insulated DC—DC converter 90 outputs a +5 VDC as a signal $V_{DD1}$ for generating a logic signal and applies this signal to a power source (not shown) of a respective switch in switching circuit 100.

In this construction, voltages corresponding to the signals S1 to S12 are applied to the common electrodes $C_1$ and $C_2$ and the data electrodes $D_1$ and $D_2$. Since the switching circuit 100 of the liquid crystal display device accords with so-called ½ bias drive method, when the absolute value of the voltage across the two electrodes of a respective one of the pixels $G_1$ to $G_4$ becomes twice the supply voltage V, namely 2 V, that pixel will operate and light. Thus, the pixels $G_1$, $G_2$, $G_3$, and $G_4$ light.

After the pixels have been lit for a predetermined time, namely, after a predetermined pattern has appeared and a marking has been performed, the voltage supply should be turned off and the pattern on the liquid crystal display device should be switched at a predetermined display switching time $t_{OFF}$. This is because the lens of the laser marker should be travelled within the display switching time $t_{OFF}$ (see elements (h) and (j) of FIG. 13).

However, before a pattern is written, the liquid crystal display device should be satisfactorily discharged. Otherwise, the previously written image may remain. In other words, a residual image of the previously written image may continue, thereby degrading the quality of the marking.

Figure 13:
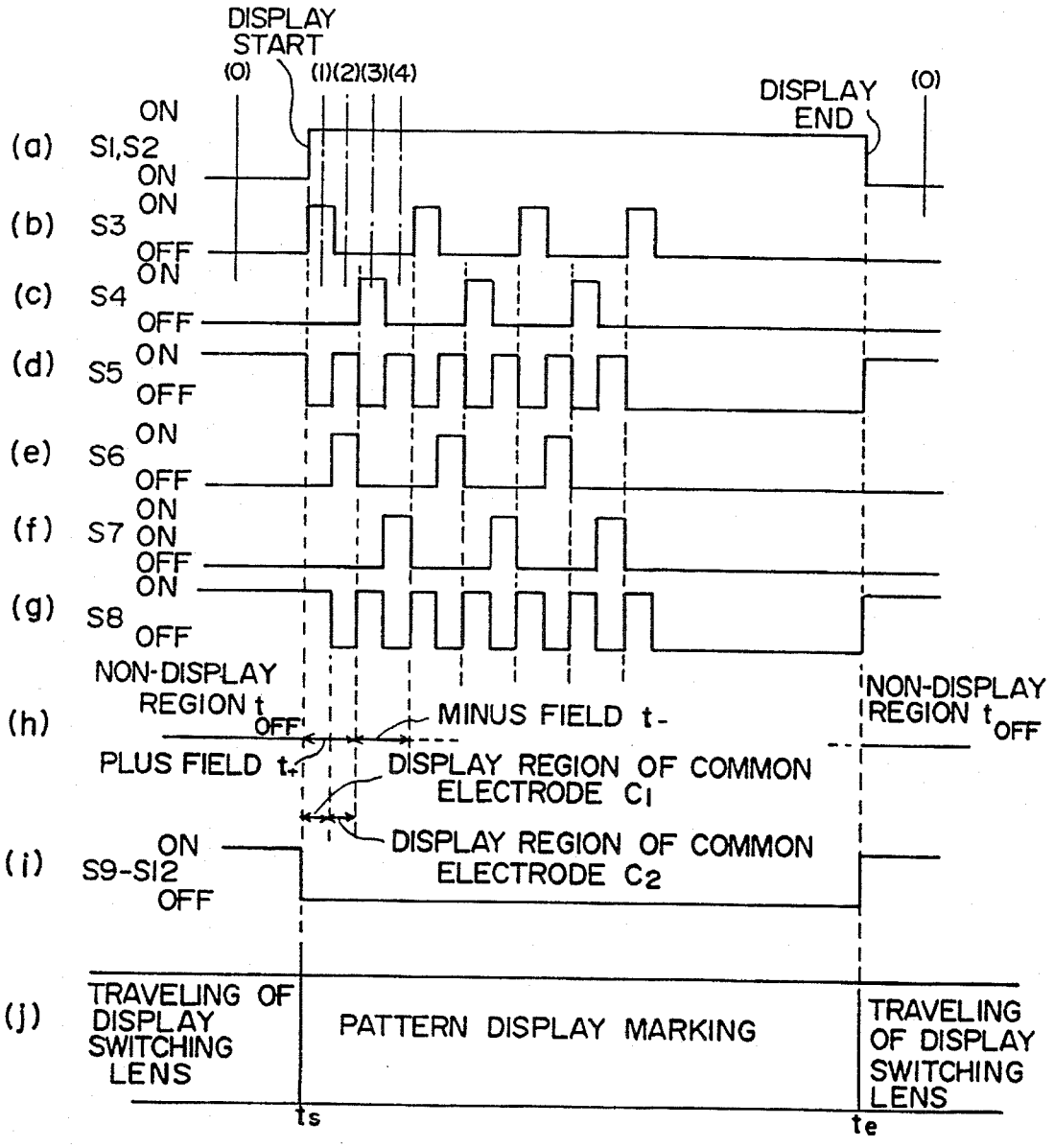
FIG. 13 is a timing chart showing the operation of the drive circuit of FIG. 12.

In the third embodiment, this problem is solved by the following manner. FIG. 13 shows a timing chart of the operation signals S1 to S12. In the display interval $t_s$ to $t_e$, the signal states are repeatedly changed with a pattern of (1), (2), (3), and (4).

Figure 15:
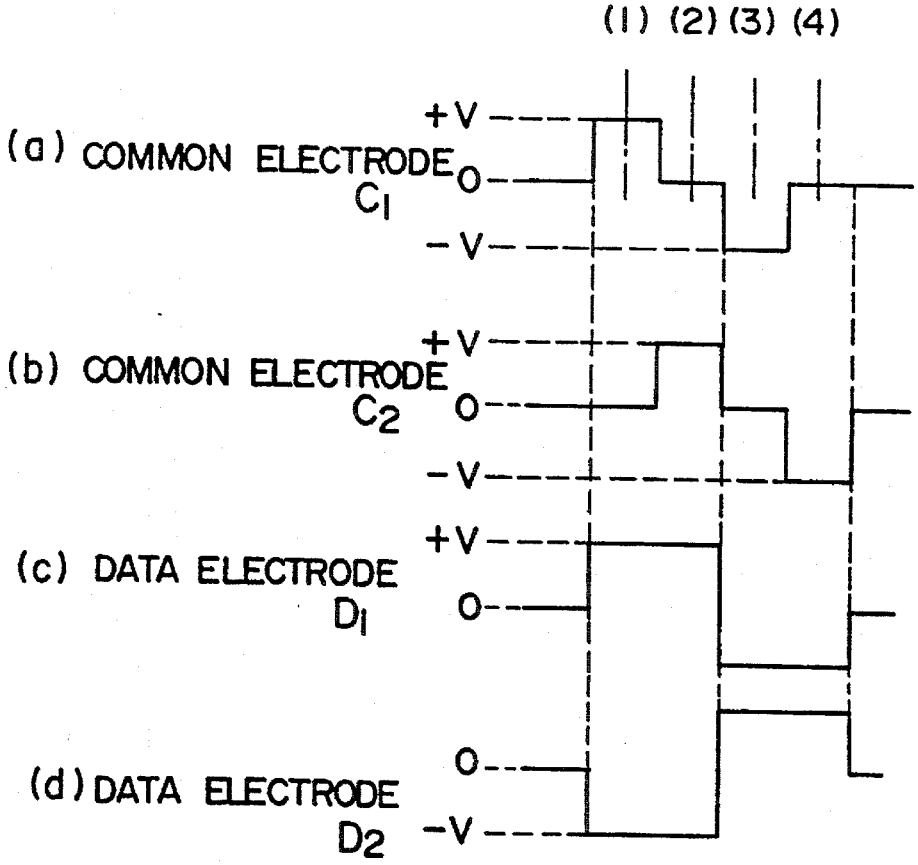
FIG. 15 is a timing chart showing the relation between voltage changes at the common electrode and the data electrode of each pixel of FIG. 14 and the operations shown in FIG. 13.
Figure 16:
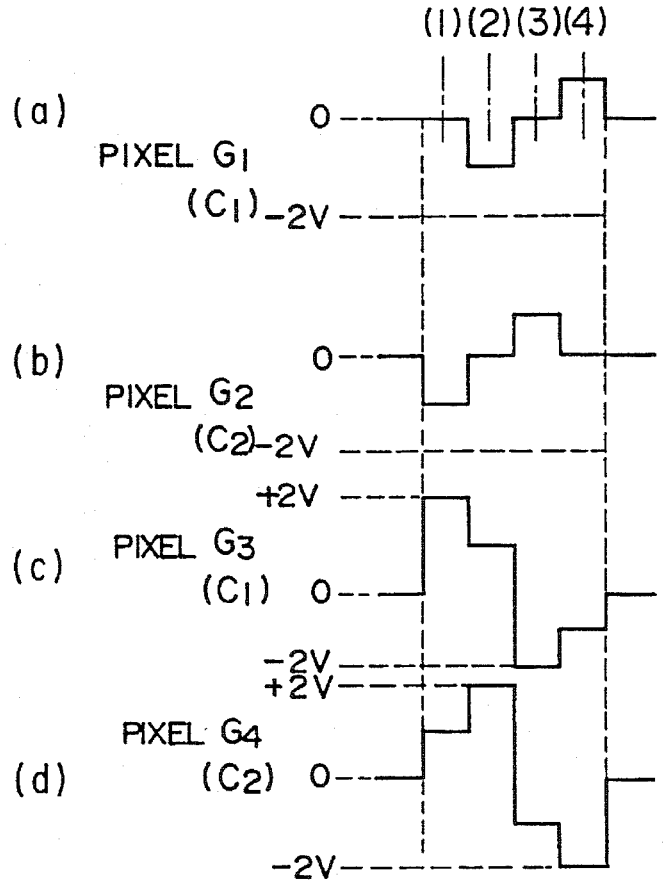
FIG. 16 is a timing chart showing the relation between voltage changes across the electrodes of each pixel of FIG. 14 and the operations shown in FIG. 13.

Waveforms (a) to (d) in FIG. 15 are timing charts showing the relation between voltage changes of the common electrodes $C_1$ and $C_2$ and the data electrodes $D_1$ and $D_2$ and the state changes (1) to (4) of the operation signals. Waveforms (a) to (d) of FIG. 16 are timing charts showing the relation between voltage changes across the electrodes of the pixels $G_1$ to $G_4$ and the state changes (1) to (4) of the operation signals.

The switching circuit generates logic signals −V (low level) and (−V+5) volts (high level) corresponding to the input Signal $V_{ss}$. (−V) and the signal $V_{DD1}$ (+5 volts). According to the logic states of the logic signals, voltages corresponding to the signals $V_{DD2}$ and $V_{ss}$ are applied to the data electrodes $D_1$ and $D_2$, respectively. In this circuit, where one signal (for example, $V_{DD2}$) is applied to one data electrode (for example, $D_1$), the other signal ($V_{ss}$) should be applied to the other data terminal ($D_2$).

Next, with reference to FIGS. 12 to 16, the operation will be described. In a non-display region, from $t_e$ to the next subsequent $t_s$, where no image is displayed, the signal state is (0) as shown in FIG. 13. This signal state will be described later in detail. When the display switching time $T_{OFF}$ elapsed from the former display end time $t_e$ to the next subsequent time $t_s$, the signal state becomes (1) and the display state starts. The display switching time $T_{OFF}$ is set to, for example, 20 msec.

After the time $t_s$, the operation signals S1 and S2 are turned on so as to apply a voltage to each electrode. Thus, both of the switches SW1 and SW2 for supplying voltages are in Their closed position (see waveform (a) of FIG. 13). In addition, the operation signals S9 to S12 are turned off so that each of the switches SW9 to SW12 is in its opened position, after having discharged the electric charge on each pixel electrode, so as to prevent each electrode from being grounded at the same time (see waveform (i) of FIG. 13).

In the region of the signal state (1), the switch SW3 is closed (S3 is turned on), thereby connecting the second terminal of switch SW1 to the first common electrode $C_1$, and the switches SW4 and SW5 are opened (S4 and S5 are turned off), thereby disconnecting the first common electrode $C_l$ from ground (see waveforms (b), (c), and (d) of FIG. 13). Thus, the voltage +V is applied to the first common electrode $C_1$ (see waveform (a) of FIG. 15). In addition, the voltage +V is applied to the first data electrode $D_1$, whereas the voltage −V is applied to the second data electrode $D_2$ (see waveforms (c) and (d) of FIG. 15). Thus, the voltage difference of the pixel $G_1$ which corresponds to the first common electrode $C_1$ and the first data electrode $D_1$ becomes 0 V. Thus, the state of the pixel $G_1$ becomes the non-display state (see waveform (a) of FIG. 16). The voltage difference of the pixel $G_3$ which corresponds to the first common electrode $C_1$ and the second data electrode $D_2$ becomes +2 V. Thus, the pixel $G_3$ lights (see waveform (c) of FIG. 16). In other words, the state (1) of the operation signals accords with the display region of the common electrode $C_1$. In this region, the pixels $G_1$ and $G_3$ corresponding to the first common electrode $C_1$ are driven.

In the region of the signal state (2), the switch SW6 is closed (S6 is turned on), thereby connecting the second terminal of switch SW1 to the second common electrode $C_2$, and the switches SW7 and SW8 are opened (S7 and S8 are turned off), thereby disconnecting the second common electrode $C_2$ from ground (see waveforms (e), (f), and (g) of FIG.13). Thus, the voltage +V is applied to the second common electrode $C_2$ (see waveform (b) of FIG. 15). In addition, the voltage +V is applied to the first data electrode $D_1$, whereas the voltage −V is applied to the second data electrode $D_2$ (see waveforms (c) and (d) of FIG. 15). Thus, the voltage difference of the pixel $G_2$ which corresponds to the second common electrode $C_2$ and the first data electrode $D_1$ becomes 0 V. Therefore, the state of the pixel $G_2$ becomes the non-display state (see waveform (b) of FIG. 16). The voltage difference of the pixel $G_4$ which corresponds to the second common electrode $C_2$ and the second data electrode $D_2$ becomes +2 V. Thus, the pixel $G_4$ lights (see waveform (d) of FIG. 16). In other words, the state (2) of the operation signals accord with the display region of the second common electrode $C_2$. In this region, the pixels $G_2$ and $G_4$ corresponding to the second common electrode $C_2$ are driven.

The plus field $t_+$ of the region of the signal states (1) and (2) is set to, for example, 4.17 msec. When a DC voltage is applied to the liquid crystal display device, an electrolysis takes place. Thus, the life of the liquid crystal display device may be shortened. To prevent this problem, in the minus field $t_-$ of the region of the signal states (3) and (4), the voltages applied to the data electrodes $D_1$ and $D_2$ are inverted.

In the region of the signal state (3), the switch SW4 is closed (S4 is turned on), thereby connecting the second terminal of switch SW2 to the first common electrode $C_1$, and the switches SW3 and SW5 are opened (S3 and S5 are turned off), thereby disconnecting the first common electrode $C_1$ from the second terminal of switch SW1 and from ground (see waveforms (b), (c), and (d) of FIG. 13). Thus, the voltage −V is applied to the first common electrode $C_1$ (see waveform (a) of FIG. 15). In addition, the voltage −V is applied to the first data electrode $D_1$, whereas the voltage +V is applied to the second data electrode $D_2$ (see waveforms (c) and (d) of FIG. 15). Thus, the voltage difference across the terminals of the pixel $G_1$ which corresponds to the first common electrode $C_1$ and the first data electrode $D_1$ becomes 0 V. Therefore, the state of pixel $G_1$ becomes the non-display state (see waveform (a) of FIG. 16). The voltage difference across the terminals of the pixel $G_3$ which correspond to the first common electrode $C_1$ and the second data electrode $D_2$ becomes −2 V. Thus, the pixel $G_3$ lights (see waveform (c) of FIG. 16). In other words, the state (3) of the operation signals accords with the display region of the first common electrode $C_1$. In this region, the pixels $G_1$ and $G_3$ corresponding to the first common electrode $C_1$ are driven.

In the region of the signal state (4), the switch SW7 is closed (S7 is turned on), thereby connecting the second terminal of switch SW2 to the second common electrode $C_2$, and the switches SW6 and SW8 are opened (S6 and S8 are turned off), thereby disconnecting the second common electrode $C_2$ from the second terminal of switch SW1 and from ground (see waveforms (e), (f), and (g) of FIG. 13). Thus, the voltage −V is applied to the second common electrode $C_2$ (see waveform (b) of FIG. 15). In addition, the voltage −V is applied to the first data electrode $D_1$, whereas the voltage +V is applied to the second data electrode $D_2$ (see waveforms (c) and (d) of FIG. 15). Thus, the voltage difference across the terminals of the pixel $G_2$ which corresponds to the electrodes $C_2$ and $D_1$ becomes 0 V. Therefore, the state of pixel $G_2$ becomes the non-display state (see waveform (b) of FIG. 16). The voltage difference across the terminals of the pixel $G_4$ which corresponds to the electrodes $C_2$ and $D_2$ becomes −2 V. Thus, the pixel $G_4$ lights (see FIG. 16 (d)). In other words, the state (4) of the operation signals accord with the display region of the common electrode $C_2$. In this region, the pixels $G_2$ and $G_4$ corresponding to the common electrode $C_2$ are driven. The minus field t_of the region of the signal states (3) and (4) is set to, for example, 4.17 msec as in the plus field $t_+$.

The above signal states (1) to (4) are repeatedly changed. Thus, each pixel lights. When time $t_e$ has elapsed, the display stop process is executed.

In other words, in the signal state (0) of the non-display region from $t_e$ to the next $t_s$, after the time $t_e$, the operation signals S1 and S2 are turned off so as to shut off the voltage supply route to each electrode. Thus, both of the voltage supply switches SW1 and SW2 are in their opened position (see waveform (a) of FIG. 13). In addition, within the display switching time $t_{OFF}$, any electric charges applied to the common electrodes $C_1$ and $C_2$ and the data electrodes $D_1$ and $D_2$ are discharged. Thus, the voltages of the electrodes $C_1$, $C_2$, $D_1$, and $D_2$ become identical so that a residual image does not remain in the next display operation.

In other words, the operation signals S5 and S8 are turned on, thereby connecting each of the common electrodes $C_1$ and $C_2$ to ground, and the operation signals S9 to S12 are turned on, thereby connecting each of the data electrodes $D_1$ and $D_2$ and the common electrodes $C_1$ and $C_2$ to ground (see waveforms (d), (g), and (i) of FIG. 13). Thus, both of the switches SW5 and SW8 for discharging the electric charges on the common electrodes $C_1$ and $C_2$ are closed, whereas all of the switches SW9 to SW12 for discharging electric charges on the data electrodes $D_1$ and $D_2$ and the common electrodes $C_1$ and $C_2$ are closed. Therefore, the electrodes $D_1$, $D_2$, $C_1$, and $C_2$ are grounded at the same time.

As described above, the switches SW9 to SW12 which are photo MOS switches have a very low on-resistance $R_p$. Thus, while electric charges are being discharged, the time constant $CR_p$ becomes very small (where C is static capacitance). Thus, electric charges are quickly discharged. Therefore, an image can be displayed at a high speed. Even if the display switching time $t_{OFF}$ becomes as short as 20 msec, electric charges can be satisfactorily discharged within this time. Thus, since the voltages of the common electrodes become the same as those of the data electrodes, a residual image can be effectively prevented.

In addition, a photo MOS switch has a characteristic where the on-resistance $R_p$ is disproportional to the operation time $t_p$. Thus, with the switches SW9 to SW12 having long operation time $t_p$ and small on-resistance $R_p$, electric charges are more quickly discharged. Therefore, a residual image can be more effectively prevented. The operation time $t_p$ of the switches SW9 to SW12 is at most 1.7 msec. Thus, this operation time does not significantly affect the display switching time $t_{OFF}$ which is around 20 msec.

Figure 17:
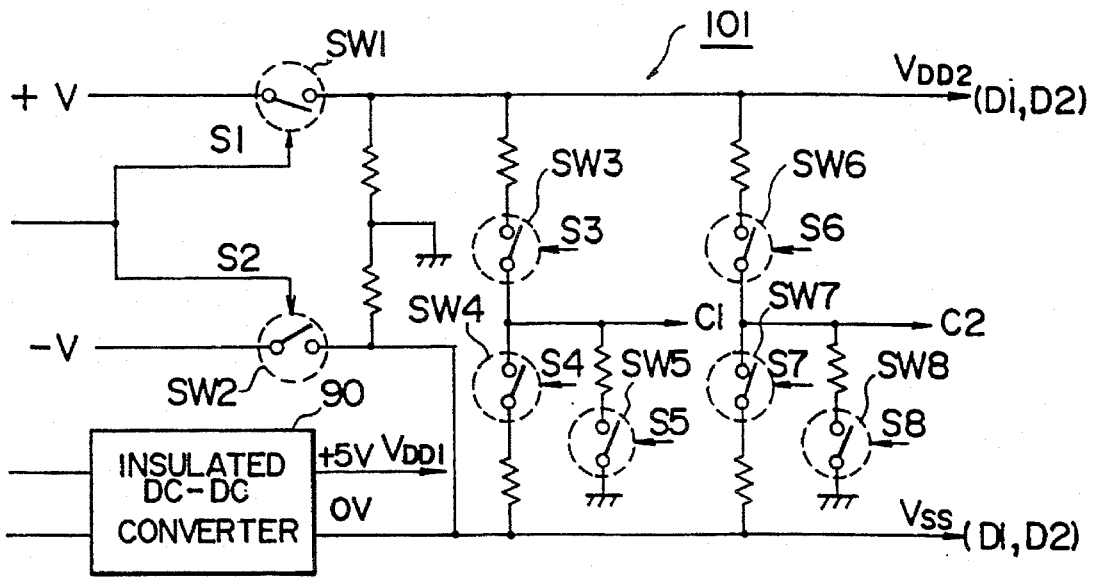
FIG. 17 is a circuit diagram showing a fourth embodiment of the present invention as a drive circuit for the multiplex drive method.

On the other hand, when only switches SW5 and SW8, which are analog switches, are used, the operation time $t_a$ is as fast as 300 nsec. However, since the on-resistance $R_a$ is very large, electric charges are not satisfactorily discharged within the short display switching time. Thus, a residual image may take place. Therefore, this construction is improper for a high speed marking. However, this construction is sufficient to a low speed marking. Thus, with a switching circuit 101 according to a fourth embodiment as shown in FIG. 17, with only the switches SW1 to SW8 (omitting the switches SW9 to SW12), electric charges are discharged. Thus, a residual image can be prevented.

When the switches SW5, SW8, SW9, and SW10 shown in FIG. 12 are devices with a fast operation time and small on-resistance, the switches SW11 and SW12 which are disposed in parallel with the switches SW5 and SW8 can be omitted. In this case, the switches SW5, SW8, SW9, and SW10 which have a fast operation speed can be used in the display interval from $t_s$ to $t_e$ since the signal state is changed at half interval of 4.17 msec. On the other hand, as the switches SW5, SW8, SW9, and SW10 have a small on-resistance, a high speed switching operation can be performed in the non-display interval from $t_e$ to the next subsequent $t_s$.

According to the third and fourth embodiments, even if a liquid crystal display device is switched at high speed, a residual image can be effectively prevented.

Reasonable variations and modifications are possible within the scope of the foregoing description, the drawings and the appended claims to the invention.

We claim:

1. A circuit for operating a transmissive scattered liquid crystal display device, said circuit comprising:

a transmissive scattered liquid crystal display device having a plurality of pixels, each of said pixels having a common terminal and a data terminal, a first common electrode connected to the common terminal of each of a first group of said plurality of pixels, a second common electrode connected to the common terminal of each of a second group of said plurality of pixels, and a plurality of data electrodes, each of said data electrodes being connected to the data terminal of a respective one of the pixels in each of said first and second groups of pixels;

a shift register;

a display signal circuit for serially sending a display signal with a logic signal level to said shift register;

a plurality of gates, each of said gates functioning as an exclusive OR circuit, each of said gates having an input adapted to receive a signal from said shift register;

a plurality of switching devices, each of said switching devices having a withstand voltage which is higher than said logic signal level, each said switching device having an input connected to an output of a respective one of said plurality of gates, each said switching device having a data output, the data output of each switching device being connected to a respective data electrode of said transmissive scattered liquid crystal display device;

wherein each gate and the switching device to which it is connected constitute, along with said shift register, a drive path, each drive path being formed as part of an IC;

a logic signal circuit for applying to a first input of each of said plurality of gates a logic signal for designating the plus and minus of a voltage applied to said liquid crystal display device;

a switching circuit connected to said first and second common electrodes of said transmissive scattered liquid crystal display device, thereby multiplex-driving said transmissive scattered liquid crystal display device.

2. A circuit in accordance with claim 1 having a plurality of ICs, each of said ICs comprising a shift register and a plurality of said drive paths.

3. A circuit in accordance with claim 2, wherein a respective drive path cooperates with said switching circuit to apply a voltage corresponding to a drive command between the common terminal of a pixel and the data terminal of that pixel so as to cause that pixel to light and to turn off said drive command in a predetermined display switching time so as to switch the display of that pixel;

wherein each common electrode is connected to a respective first switch, each first switch having a small on-resistance;

wherein each data electrode is connected to a respective second switch, each second switch having a small on-resistance;

wherein said first and second switches are adapted to discharge electric charges applied on the common electrodes and the data electrodes in a predetermined discharge time;

said first and second switches being closed when said drive command is turned off so that the voltages of the common terminals and the data terminals of the pixels become identical, thereby preventing a residual image of said liquid crystal display device from taking place.

4. A circuit in accordance with claim 3, wherein each of said first and second switches is a photo MOS switch.

5. A circuit in accordance with claim 1, wherein a respective drive path cooperates with said switching circuit to apply a voltage corresponding to a drive command between the common terminal of a pixel and the data terminal of that pixel so as to cause that pixel to light and to turn off said drive command in a predetermined display switching time so as to switch the display of that pixel;

wherein each common electrode is connected to a respective first switch, each first switch having a small on-resistance;

wherein each data electrode is connected to a respective second switch, each second switch having a small on-resistance;

wherein said first and second switches are adapted to discharge electric charges applied on the common electrodes and the data electrodes in a predetermined discharge time;

said first and second switches being closed when said drive command is turned off so that the voltages of the common terminals and the data terminals of the pixels become identical, thereby preventing a residual image of said liquid crystal display device from taking place.

6. A drive circuit for use with a transmissive scattered liquid crystal display device having a plurality of pixels, each of said pixels having a common terminal connected to a common electrode and a data terminal connected to a data electrode;

said drive circuit being adapted to apply voltages corresponding to a drive command between the common terminal of a pixel and the data terminal of that pixel so as to cause that pixel to light;

said drive circuit being adapted to turn off said drive command in a predetermined display switching time so as to switch the display of that pixel;

wherein each common electrode is connected to a first switch having a small on-resistance;

wherein each data electrode is connected to a second switch having a small on-resistance;

wherein said first and second switches are adapted to discharge electric charges applied on the common terminals and the data terminals in a predetermined discharge time;

said first and second switches being closed when said drive command is turned off so that the voltages of the common terminal and the data terminal of each pixel become identical, thereby preventing a residual image of said liquid crystal display device from taking place.

7. A drive circuit in accordance with claim 6, wherein each of said first and second switches is a photo MOS switch.

* * * * *